US005279393A

United States Patent [19]

Lloyd

[11] Patent Number: 5,279,393

[45] Date of Patent: Jan. 18, 1994

[54] AUTOMATIC STORAGE AND RETRIEVAL MACHINE WITH IMPROVED CARRIAGE SIDE GUIDE ROLLER ARRANGEMENT

[75] Inventor: Kurt M. Lloyd, Pewaukee, Wis.

[73] Assignee: Harnischfeger Engineers, Inc., Brookfield, Wis.

[21] Appl. No.: 990,465

[22] Filed: Dec. 15, 1992

[51] Int. Cl.[5] ..... B66B 7/04

[52] U.S. Cl. ..... 187/95; 414/282

[58] Field of Search ..... 414/277-283; 187/95

[56] References Cited

U.S. PATENT DOCUMENTS

| | | | |
|---|---|---|---|
| 3,669,222 | 6/1972 | Takamura et al. | 187/95 |
| 4,316,528 | 2/1982 | Dechantstreiter | 187/9 E |
| 4,442,922 | 4/1984 | Johannson | 187/95 X |
| 5,015,140 | 5/1991 | Kling | 414/282 |
| 5,033,589 | 7/1991 | Rhodes | 187/95 |
| 5,048,642 | 9/1991 | Lloyd | 187/95 X |
| 5,086,882 | 2/1992 | Sugahara et al. | 187/95 |
| 5,091,685 | 2/1992 | Sorensen et al. | 414/281 X |
| 5,193,651 | 3/1993 | Shigeta et al. | 187/95 |

*Primary Examiner*—David A. Bucci

*Attorney, Agent, or Firm*—Michael, Best & Friedrich

[57] ABSTRACT

A storage and retrieval machine comprising a mast having a generally vertical outer surface, a carriage movable vertically along the mast, a bearing assembly including a wheel which is rotatably supported by the carriage, which rolls along the mast surface, and which is movable relative to the carriage in the direction perpendicular to the mast surface, a pad of low-friction material mounted on the carriage, and a spring biasing the wheel toward the mast surface such that the pad is normally spaced from the mast surface and such that the wheel moves relative to the carriage so that the pad engages the mast surface when the force exerted on the wheel by the mast surface exceeds a predetermined amount, and a shuttle supported by the carriage for horizontal movement relative thereto.

20 Claims, 3 Drawing Sheets

Fig. 5

AUTOMATIC STORAGE AND RETRIEVAL MACHINE WITH IMPROVED CARRIAGE SIDE GUIDE ROLLER ARRANGEMENT

BACKGROUND OF THE INVENTION

The invention relates to storage and retrieval machines, and more particularly to carriage side guide roller arrangements for storage and retrieval machines.

A conventional storage and retrieval machine includes a base movable horizontally along the floor. A mast extends upwardly from the base, and the upper end of the mast runs along a rail supported above the floor. A carriage moves vertically along the mast, and a shuttle moves horizontally relative to the carriage for depositing loads on and picking up loads from a storage rack adjacent the storage and retrieval machine.

The carriage is typically supported for movement along the mast by a plurality of rollers engaging generally vertical surfaces on the mast. Among these rollers are the carriage side guide rollers, which engage mast surfaces extending perpendicular to the direction of carriage and base movement. During the normal vertical cycle of the carriage the carriage side guide rollers are under very little load. However, high forces are realized in the carriage side guide rollers when the shuttle extends to pick up or deposit loads. These forces increase significantly with long reach shuttle cycles and/or with heavier loads.

The high forces on the carriage side guide rollers cause high roller contact pressure on the mast. This can cause excessive wear and deflection in the parent metal, ultimately resulting in mast and/or roller failure. Rollers have been made larger or duplexed in order to handle these high loads. This results in cost increases and mounting problems.

SUMMARY OF THE INVENTION

The invention provides an improved carriage side guide roller arrangement. During vertical motion when forces on the side guide roller are low, the roller contacts the mast to provide low-resistance vertical guidance. During the shuttle cycle, however, when the load on the guide roller increases, the roller deflects and allows a relatively large area of low-friction material to contact the mast. The pad exerts less pressure on the mast than does the roller because the pad has more surface area contacting the mast. The low-friction material allows the carriage to move short vertical distances to pick up or deposit a load. This arrangement allows the use of a small roller and thus results in space and cost savings.

Other features and advantages of the invention will become apparent to those skilled in the art upon review of the following detailed description, claims and drawings.

Figure 1:
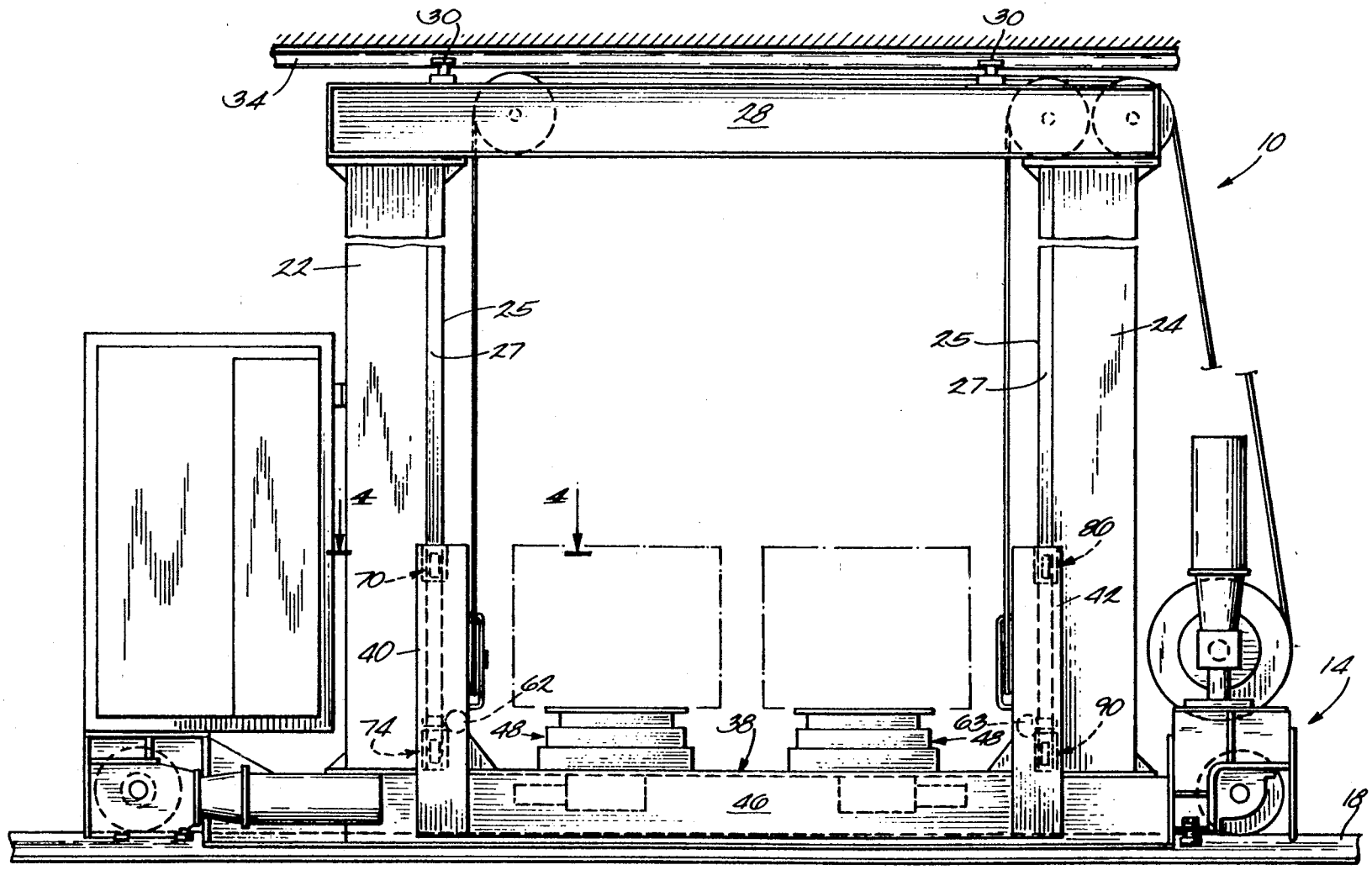
FIG. 1 is a side elevational view, partially broken away, of a storage and retrieval machine embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A storage and retrieval machine 10 embodying the invention is illustrated in the drawings. While the illustrated machine is double-masted, it should be understood that the invention is also applicable to single-masted machines.

Figure 3:
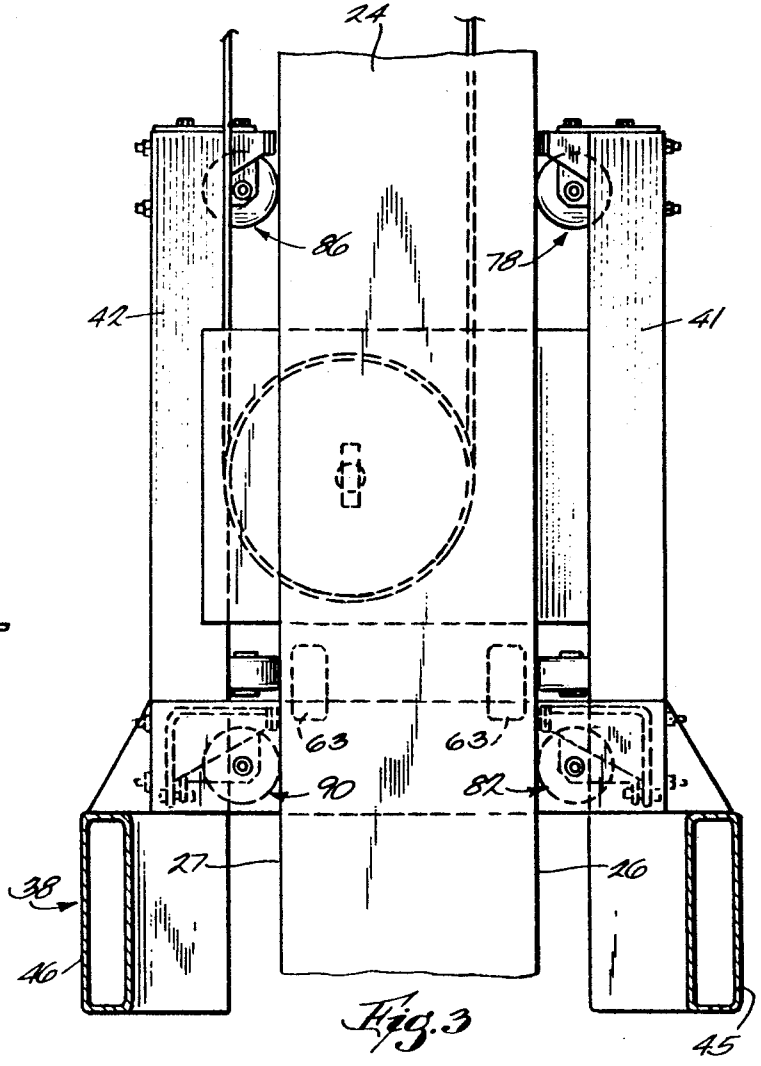
FIG. 3 is an enlarged, partial, right end view of the machine.
Figure 2:
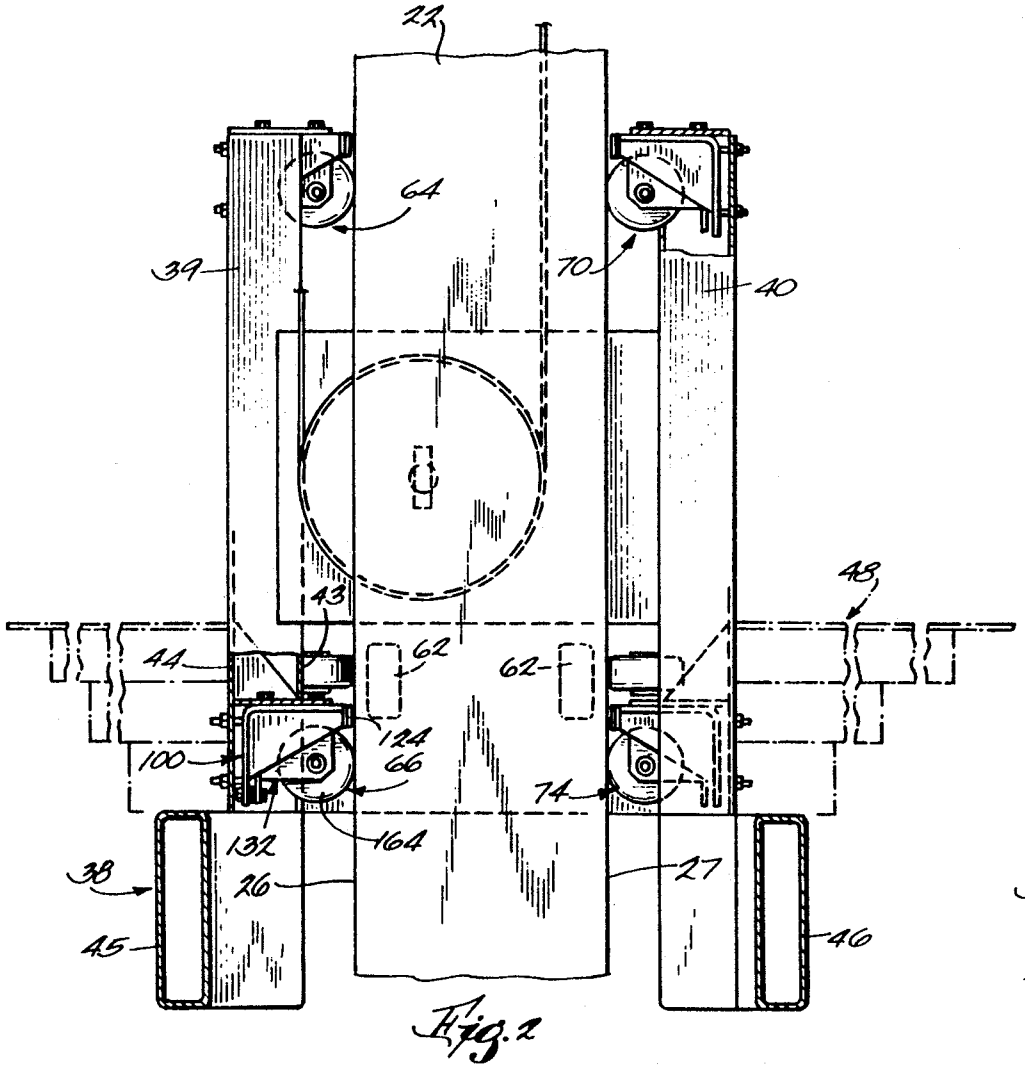
FIG. 2 is an enlarged, partial, left end view of the machine.

The machine 10 comprises (see FIG. 1) a base 14 movable horizontally along a rail 18 on a supporting surface. Two generally vertical masts 22 and 24 extend upwardly from the base 14. Each mast 22 or 24 includes (see FIGS. 1-3) a vertical inner surface 25 facing the other mast, and opposed, parallel, vertical side or outer surfaces 26 and 27 extending perpendicular to the inner surface 25. The upper ends of the masts 22 and 24 are connected by an upper truck or frame 28 (see FIG. 1). The upper frame 28 has thereon rollers 30 which roll along an upper rail 34.

Figures 4, 5, 6, 7, 8, 9:
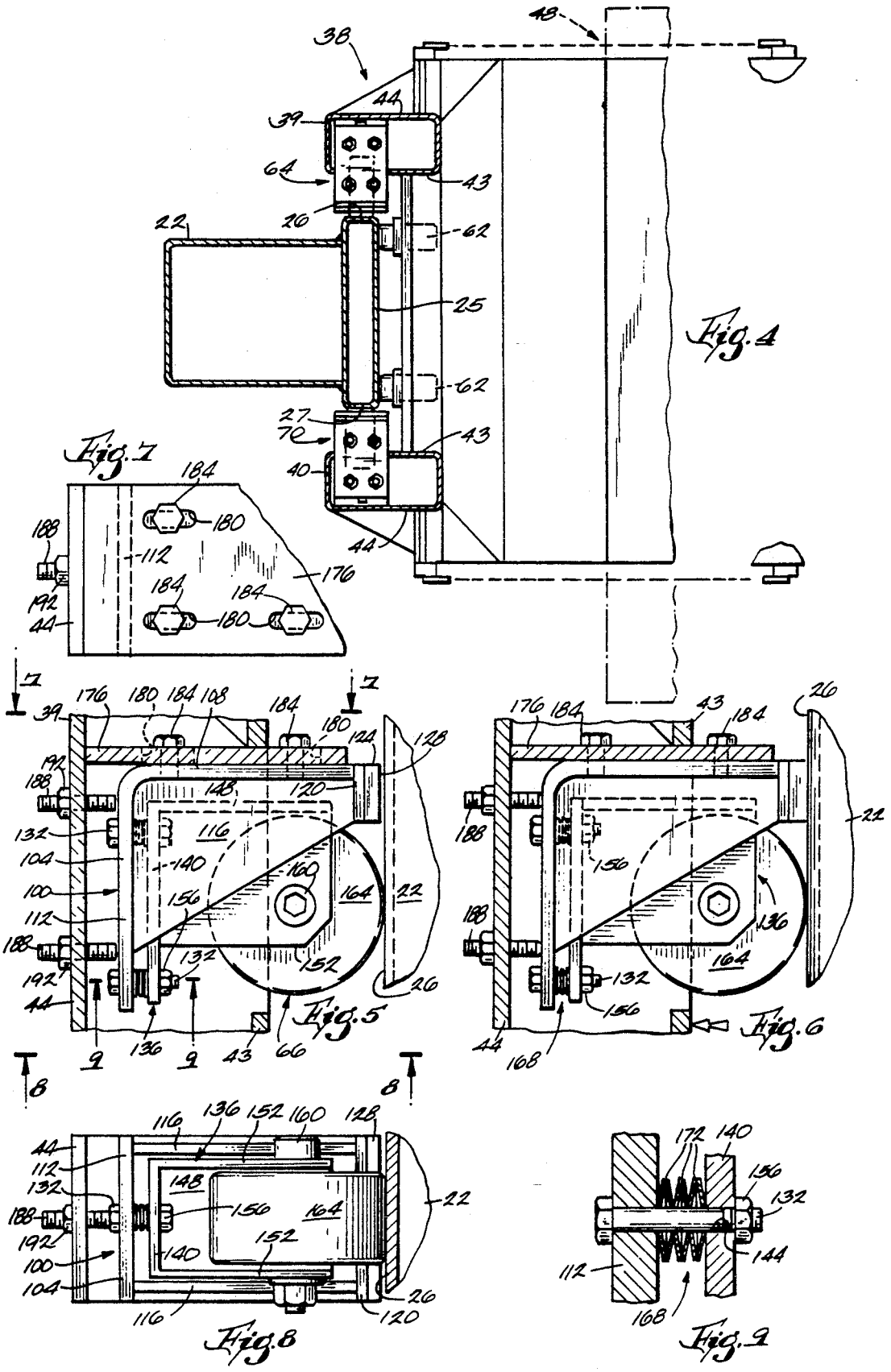
FIG. 4 is an enlarged view taken along line 4—4 in FIG. 1.
FIG. 5 is a further enlarged side elevational view of one of the side guide roller arrangements with only the roller engaging the mast.
FIG. 6 is a view similar to FIG. 5 with the low-friction pad engaging the mast.
FIG. 7 is a view taken along line 7—7 in FIG. 5.
FIG. 8 is a view taken along line 8—8 in FIG. 5.
FIG. 9 is a view taken along line 9—9 FIG. 5.

The machine also comprises (see FIGS. 1-4) a carriage 38 extending between the masts 22 and 24, and means supporting the carriage 38 for vertical movement along the masts. The carriage 38 includes a vertical post 39 adjacent the surface 26 of the mast 22, a vertical post 40 adjacent the surface 27 of the mast 22, a vertical post 41 adjacent the surface 26 of the mast 24, and a vertical post 42 adjacent the post 27 of the mast 24. As shown in FIG. 4, each of the posts 39, 40, 41 and 42 is preferably a rectangular tube having parallel inner and outer walls 43 and 44. The carriage 38 also includes (see FIGS. 2 and 3) a horizontal member 45 extending between the posts 39 and 41 and a horizontal member 46 extending between the posts 40 and 42. Shuttles 48 are supported by the members 45 and 46 for horizontal movement relative to the carriage 38 along respective axes (not shown) extending from left to right in FIG. 2 and from top to bottom in FIG. 4. The machine 10 as thus far described is conventional and will not be explained in greater detail.

The means supporting the carriage for vertical movement along the masts includes (see FIGS. 1-4), on the carriage 38, at least two rollers 62 engaging the inner surface 25 of the mast 22, and at least two rollers 63 engaging the inner surface 25 of the mast 24. The means supporting the carriage for vertical movement along the masts also includes, on the post 39, upper and lower bearing assemblies 64 and 66 engaging the side surface 26 of the mast 22, on the post 40, upper and lower bearing assemblies 70 and 74 engaging the side surface 27 of the mast 22, on the post 41, upper and lower bearing assemblies 78 and 82 engaging the side surface 26 of the mast 24, and on the post 42, upper and lower bearing assemblies 86 and 90 engaging the side surface 27 of the mast 24. The bearing assemblies 64, 66, 70, 74, 78, 82, 86 and 90 are substantially identical, and only the bearing assembly 66 will be described in detail.

The bearing assembly 66 includes (see FIGS. 5 and 8) a guide bracket 100 fixed relative to the carriage 38. The manner in which the guide bracket 100 is fixed to the carriage 38 is described below. The guide bracket 100 includes an L-shaped member 104 which is fixed to the carriage 38 and which has a plate-like horizontal portion 108 and a plate-like vertical portion 112. A pair of spaced brace plates 116 extend between the horizontal and vertical portions 108 and 112 to rigidify the guide bracket 100. A mounting plate 120 extends across the inner end of the horizontal portion 108 and the inner ends of the brace plates 116. A pad 124 of low-friction material such as Nylatron is mounted on the mounting plate 120 and has a vertical surface 128 facing the mast surface 26.

A pair of screws 132 (see FIGS. 5 and 9) extend inwardly from the vertical portion 112 and define projections extending from the guide bracket 100 and toward the mast surface 26. As shown in FIGS. 5, 6 and 8, a wheel bracket 136 is slidably mounted on the screws 132 for movement toward and away from the mast surface 26. The wheel bracket 136 includes a vertical plate 140 having therein apertures 144 (one is shown in FIG. 9) slidably receiving the screws 132, a horizontal plate 148 extending inwardly from the upper end of the vertical plate 140, and a pair of spaced brace plates 152 connecting the vertical and horizontal plates 140 and 148. Nuts 156 on the inner ends of the screws 132 limit movement of the vertical plate 140 and thus the entire wheel bracket 136 toward the mast surface 26. A bolt 160 (see FIGS. 5 and 8) extends between the brace plates 152, and a wheel or roller 164 rotates about the bolt 160. The wheel 164, which is preferably made of forged steel, engages and rolls along the mast surface 26, as shown in FIGS. 5, 6 and 8.

As shown in FIGS. 6 and 9, a spring 168 surrounds each of the screws 132 and extends between the guide bracket vertical portion 112 and the wheel bracket vertical plate 140. Preferably, as shown in FIG. 9, the spring 168 is comprised of six disc springs 172. It should be understood that other types of springs can be employed. The disc springs 172 bias the wheel bracket 136 and the wheel 164 toward the mast surface 26 such that the pad 124 is normally spaced from the mast surface 26 (as shown in FIG. 5) and such that, when the force exerted on the wheel 164 by the mast surface 26 exceeds a predetermined amount, the wheel bracket 136 and the wheel 164 move outwardly relative to the carriage 38 or toward the guide bracket vertical portion 112 so that the pad 124 engages the mast surface 26. In the case of the bearing assembly 66, the force exerted on the wheel 164 by the mast surface 26 exceeds this predetermined amount when either shuttle 42 is extended to the left in FIG. 2.

The guide bracket 100 is fixed to the carriage 38 as follows. The guide bracket 100 is fixed to the underside of a horizontal plate 176 (see FIGS. 5–7) supported by the post 39. The plate 176 is secured to the post 39 by suitable means such as welding and extends inwardly from the outer wall 44 through an opening in the inner wall 43. The plate 176 has therein four slots 180 (three are shown in FIG. 7) that are elongated in the direction perpendicular to the mast surface 26. Extending through each slot 180 is a respective screw 184 having a head engaging the top of the plate 176 and having a lower end threaded into the horizontal portion 108 of the guide bracket 100. Adjustment of the position of the screws 184 within the slots 180 adjusts the position of the guide bracket 100 relative to the plate 176. The guide bracket 100 is fixed relative to the plate 176 (and thus relative to the carriage 38) when the screws 184 are tightened.

Means are provided for setting the position of the guide bracket 100 relative to the post 39. Such means preferably includes (see FIGS. 5–8) upper and lower set screws 188 threaded into and extending through the outer wall 44 of the post 39. The set screws 188 have respective inner ends engaging the guide bracket vertical portion 112, so that movement of the inner ends toward the mast surface 26 moves the guide bracket 100 toward the mast surface 26. Accordingly, when the carriage 38 is mounted on the masts 22 and 24, adjustment of the set screws 188 adjusts the position of the guide bracket 100 relative to the mast surface 26 and thereby adjusts the spacing between the pad 124 and the mast surface 26. Nuts 192 are tightened to fix the set screws 188 relative to the post 39.

Viewed alternatively, the means supporting the carriage 38 for vertical movement along the mast 22 includes a first bearing member (the wheel 164) which is supported by the carriage 38 and which engages the mast 22 such that the mast exerts a load on the first bearing member, a second bearing member (the pad 124) which is supported by the carriage 38 and which is normally spaced from the mast 22, and means for shifting at least part of the load on the first bearing member to the second bearing member when the load on the first bearing member exceeds a predetermined amount (i.e., the amount necessary to deflect the springs 168). The springs 168 shift at least part of the load to the pad 124 by allowing displacement of the wheel 164 relative to the carriage 38 when the load exceeds the predetermined amount. Shifting the load to the pad 124 reduces the force exerted on the mast surface 26 by the wheel 164 and causes the pad 124 to exert a force on the mast surface 26. This is advantageous because the pressure exerted by the pad 124 is substantially less than the pressure exerted by the wheel 164 due to the substantially greater surface area of the pad 124 engaging the mast surface 26.

Various features of the invention are set forth in the following claims.

I claim:

1. A storage and retrieval machine comprising a generally vertical mast, a carriage, means supporting said carriage for vertical movement along said mast, said supporting means including a first bearing member which is supported by said carriage and which engages said mast such that said mast exerts a load on said first bearing member, a second bearing member which is supported by said carriage and which is normally spaced from said mast, and means for shifting at least part of said load to said second bearing member when said load exceeds a predetermined amount, and a shuttle supported by said carriage for horizontal movement relative thereto.

2. A machine as set forth in claim 1 wherein said first bearing member is a roller rotatably supported by said carriage.

3. A machine as set forth in claim 1 wherein said second bearing member is a pad of low-friction material mounted on said carriage.

4. A machine as set forth in claim 1 wherein said shifting means includes means for allowing displacement of said first bearing member relative to said carriage when said load exceeds said predetermined amount.

5. A machine as set forth in claim 4 wherein said means for allowing displacement of said first bearing member includes means for biasing said first bearing member toward said mast.

6. A machine as set forth in claim 1 wherein said shuttle is movable relative to said carriage along a generally horizontal axis, wherein said mast includes an outer surface extending perpendicular to said axis, and wherein said first bearing member engages said outer surface of said mast.

7. A machine as set forth in claim and further comprising a base movable horizontally along a supporting surface, and wherein said mast is supported by said base.

8. A machine as set forth in claim 1 wherein said supporting means also includes a guide bracket fixed to said carriage, a projection extending from said guide bracket and toward said mast, a wheel bracket slidably mounted on said projection for movement toward and away from said mast, and means on said projection for limiting movement of said wheel bracket toward said mast, wherein said first bearing member is a wheel rotatably mounted on said wheel bracket, wherein said spring surrounds said projection and extends between said guide bracket and said wheel bracket so as to bias said wheel bracket toward said mast, and wherein said second bearing member is a pad mounted on said guide bracket.

9. A machine as set forth in claim 8 wherein said supporting means further includes a second projection extending from said guide bracket and toward said mast, said wheel bracket being slidably mounted on said second projection for movement toward and away from said mast, means on said second projection for limiting movement of said wheel bracket toward said mast, and a second spring surrounding said second projection and extending between said guide bracket and said wheel bracket so as to bias said wheel bracket toward said mast.

10. A machine as set forth in claim 1 wherein said supporting means also includes means for adjusting the spacing between said second bearing member and said mast.

11. A storage and retrieval machine comprising a mast having a generally vertical outer surface, a carriage movable vertically along said mast, a bearing assembly including a wheel which is rotatably supported by said carriage, which rolls along said mast surface, and which is movable relative to said carriage in a direction perpendicular to said mast surface, a pad of low-friction material mounted on said carriage, and a spring biasing said wheel toward said mast surface such that said pad is normally spaced from said mast surface and such that said wheel moves relative to said carriage so that said pad engages said mast surface when a force exerted on said wheel by said mast surface exceeds a predetermined amount, and a shuttle supported by said carriage for horizontal movement relative thereto.

12. A machine as set forth in claim 11 and further comprising a base movable horizontally along a supporting surface, and wherein said mast is supported by said base.

13. A machine as set forth in claim 11 wherein said bearing assembly also includes a guide bracket fixed to said carriage, a projection extending from said guide bracket and toward said mast surface, a wheel bracket slidably mounted on said projection for movement toward and away from said mast surface, and means on said projection for limiting movement of said wheel bracket toward said mast surface, wherein said wheel is rotatably mounted on said wheel bracket, wherein said spring surrounds said projection and extends between said guide bracket and said wheel bracket so as to bias said wheel bracket toward said mast surface, and wherein said pad is mounted on said guide bracket.

14. A machine as set forth in claim 13 wherein said bearing assembly further includes a second projection extending from said guide bracket and toward said mast surface, said wheel bracket being slidably mounted on said second projection for movement toward and away from said mast surface, means on said second projection for limiting movement of said wheel bracket toward said mast surface, and a second spring surrounding said second projection and extending between said guide bracket and said wheel bracket so as to bias said wheel bracket toward said mast surface.

15. A machine as set forth in claim 11 wherein said shuttle is movable relative to said carriage in the direction perpendicular to said mast surface.

16. A machine as set forth in claim 11 wherein said bearing assembly also includes means for adjusting the spacing between said pad and said mast surface.

17. A storage and retrieval machine comprising a base movable horizontally along a supporting surface, a mast which is supported by said base and which has opposed, parallel, vertical surfaces, a carriage movable vertically along said mast, a shuttle movable relative to said carriage along a generally horizontal axis extending perpendicular to said mast surfaces, upper and lower bearing assemblies which are mounted on said carriage and which engage one of said mast surfaces, and upper and lower bearing assemblies which are mounted on said carriage and which engage the other of said mast surfaces, each of said bearing assemblies including a wheel which is rotatably supported by said carriage, which rolls along the associated mast surface, and which is movable relative to said carriage in a direction perpendicular to the associated mast surface, a pad of low-friction material mounted on said carriage, and a spring biasing said wheel toward the associated mast surface such that said pad is normally spaced from the associated mast surface and such that said wheel moves relative to said carriage so that said pad engages the associated mast surface when a force exerted on said wheel by the associated mast surface exceeds a predetermined amount.

18. A machine as set forth in claim 17 wherein each of said bearing assemblies also includes a guide bracket fixed to said carriage, a projection extending from said guide bracket and toward the associated mast surface, a wheel bracket slidably mounted on said projection for movement toward and away from the associated mast surface, and means on said projection for limiting movement of said wheel bracket toward the associated mast surface, wherein said wheel is rotatably mounted on said wheel bracket, wherein said spring surrounds said projection and extends between said guide bracket and said wheel bracket so as to bias said wheel bracket toward the associated mast surface, and wherein said pad is mounted on said guide bracket.

19. A machine as set forth in claim 18 wherein each of said bearing assemblies further includes a second projection extending from said guide bracket and toward the associated mast surface, said wheel bracket being slidably mounted on said second projection for movement toward and away from the associated mast surface, means on said second projection for limiting movement of said wheel bracket toward the associated mast surface, and a second spring surrounding said second projection and extending between said guide bracket and said wheel bracket so as to bias said wheel bracket toward the associated mast surface.

20. A machine as set forth in claim 17 wherein said each of said bearing assemblies also includes means for adjusting the spacing between said pad and the associated mast surface.

* * * * *

UNITED STATES PATENT AND TRADEMARK OFFICE

CERTIFICATE OF CORRECTION

PATENT NO. : 5,279,393

DATED : January 18, 1994

INVENTOR(S) : Kurt M. Lloyd

It is certified that error appears in the above—identified patent and that said Letters Patent is hereby corrected as shown below:

Column 5, line 22, after "claim" insert --1--.

Signed and Sealed this

Twenty-eighth Day of June, 1994

*Attest:*

Bruce Lehman

BRUCE LEHMAN

*Attesting Officer*

*Commissioner of Patents and Trademarks*